US008561708B2

(12) United States Patent
Johnson et al.

(10) Patent No.: US 8,561,708 B2
(45) Date of Patent: Oct. 22, 2013

(54) ID CENTRALIZER

(75) Inventors: Nicholas D. Johnson, Claremore, OK (US); David L. Olson, Los Alamitos, CA (US)

(73) Assignee: Baker Hughes Incorporated, Houston, TX (US)

( * ) Notice: Subject to any disclaimer, the term of this patent is extended or adjusted under 35 U.S.C. 154(b) by 378 days.

(21) Appl. No.: 12/986,480

(22) Filed: Jan. 7, 2011

(65) Prior Publication Data

US 2012/0175131 A1 Jul. 12, 2012

(51) Int. Cl.
*E21B 23/00* (2006.01)
*E21B 17/10* (2006.01)

(52) U.S. Cl.
USPC ..... 166/382; 166/241.1; 166/213

(58) Field of Classification Search
USPC ..... 166/382, 241.1, 105, 213, 208
See application file for complete search history.

(56) References Cited

U.S. PATENT DOCUMENTS 2,515,796 A * 7/1950 Phipps ..... 175/325.2
3,312,285 A * 4/1967 Solum ..... 166/241.6
3,343,608 A * 9/1967 Solum ..... 166/241.7
5,346,016 A 9/1994 Wilson et al.
5,692,562 A * 12/1997 Squires ..... 166/68.5
7,201,222 B2 4/2007 Kanady et al.
7,708,064 B2 5/2010 Sehsah
2009/0142141 A1* 6/2009 Lutgring ..... 405/249
2010/0243257 A1* 9/2010 Krieg et al. ..... 166/311

* cited by examiner

*Primary Examiner* — Giovanna Wright
*Assistant Examiner* — Michael Wills, III
(74) *Attorney, Agent, or Firm* — Bracewell & Giuliani LLP

(57) ABSTRACT

An apparatus and methods of spacing a tool from walls of tubing are provided as embodiments of the present invention. The apparatus can include a centralizer that is inserted in the tubing, the centralizer having inwardly arched sides or inwardly arched bow springs so that an inner diameter of the centralizer increases from a longitudinal midpoint to a longitudinal end point of the centralizer. The centralizer has a smaller diameter than the tubing so that it can be positioned inside of the tubing downstream of a seating ring in a relaxed position so that when the tool passes through the centralizer, the inwardly arched sides or inverted bow springs expand towards an inner wall of the tubing to centralize and inhibit radial movement of the tool when deployed through the inwardly arched sides of the centralizer.

28 Claims, 4 Drawing Sheets

Fig. 4
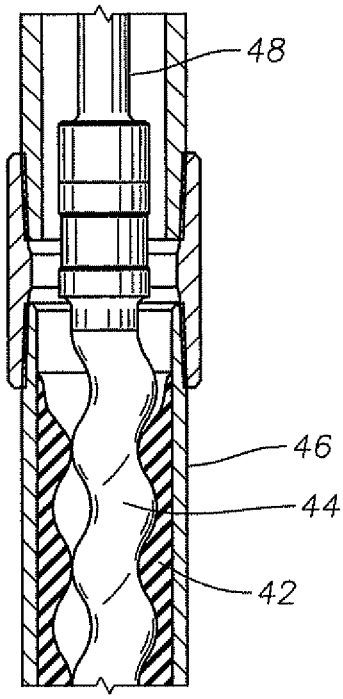
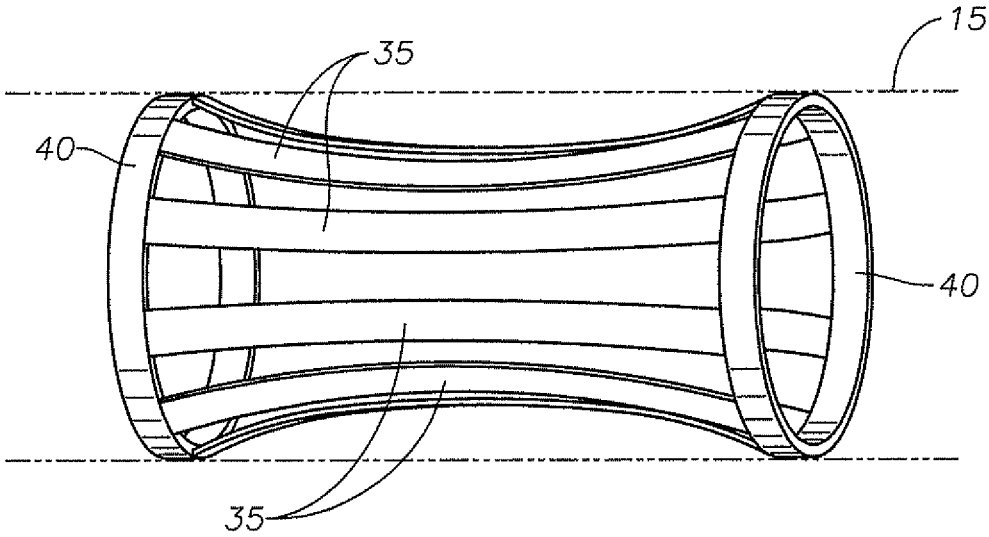
Fig. 5

ID CENTRALIZER

FIELD OF THE INVENTION

The present invention relates to systems useful for centralizing a pump or downhole tool within tubing or piping.

BACKGROUND OF THE INVENTION

Drilling and completing well bores in subterranean formations using tubular strings can be accomplished easier if the tubular string is prevented from fully eccentering and generally contacting or lying against the borehole wall. Devices, which are frequently referred to as centralizers, are used to reduce eccentricity or centralize the tubular string within the borehole. Centralizing devices are configured to economically meet a variety of drilling and completion applications.

Several types of devices have been used to centralize a tubular string in casing. For example, a bow spring has been used that includes a metal strip shaped like a hunting bow and can be attached to a tool or to the outside of casing. Bow-spring outer diameter (OD) centralizers are typically used to keep tubing in the center of a well bore or casing (i.e., centralized) prior to and during a cement job.

Although many centralizer devices are currently available, many of the centralizers have a minimum compressed diameter that limits the environments in which they can be deployed in. In particular, when equipment is contained within tubing, and has to pass through constricted diameters, it is difficult to find centralizers that can centralize the equipment within the tubing due to the compressed diameter of the tubing.

A need exists for a centralizer that can be used in applications in which a typical centralizer cannot be used. More specifically, a need exists for a centralizer that can be used for equipment that has to be passed through tubing that has a reduced diameter or constricted area.

SUMMARY

In view of the foregoing, an apparatus and methods of spacing a downhole tool from walls of pipe or tubing are provided as embodiments of the present invention. Methods of centralizing a downhole tool within a string of well pipe are also provided as embodiments of the present invention.

For example, as an embodiment, a centralizing apparatus for spacing a pump from walls of tubing is provided. In this embodiment, the apparatus includes a plurality of casing pipe sections making up a casing pipe string; a tubing contained with the casing pipe string; a seating ring positioned on an inner wall of the tubing; a pump positioned within the tubing; and a centralizer having inwardly arched sides or inwardly arched bow springs so that an inner diameter of the centralizer increases from a longitudinal midpoint to a longitudinal end point of the centralizer. The centralizer has a smaller diameter than the tubing so that it can be positioned inside of the tubing downstream of the seating ring in a relaxed position so that when the seating ring and the pump pass through the centralizer, the inwardly arched sides expand towards an inner wall of the tubing to centralize and inhibit movement of the pump when deployed through the inwardly arched sides of the centralizer.

As another embodiment of the present invention, a method of centralizing a pump from walls of tubing contained within casing pipe string is provided. In this embodiment, the casing pipe string includes tubing that has a centralizer positioned therein. In an aspect, the centralizer can be a cylindrical sleeve. The centralizer has inwardly arched sides. The method embodiment includes the steps of moving the pump through the tubing from a relaxed position to a constricted position so that when the pump passes through the centralizer, the inwardly arched sides of the centralizer expand towards an inner wall of the tubing to centralize and inhibit radial movement of the pump.

BRIEF DESCRIPTION OF THE DRAWINGS

So that the manner in which the above-recited features, aspects and advantages of the invention, as well as others that will become apparent, are attained and can be understood in detail, more particular description of the invention briefly summarized above can be had by reference to the embodiments thereof that are illustrated in the drawings that form a part of this specification. It is to be noted, however, that the appended drawings illustrate some embodiments of the invention and are, therefore, not to be considered limiting of the invention's scope, for the invention can admit to other equally effective embodiments.

FIG. 4 is a vertical cross-sectional view of a portion of a pump assembly suitable for use in embodiments of the present invention;

FIG. 5 is a schematic of the inner diameter centralizer having arched bow springs made in accordance with embodiments of the present invention;

DETAILED DESCRIPTION OF THE INVENTION

Embodiments of the present invention relate to a through tubing conveyed application in which the deployed pump hangs off of a seating assembly that is deployed through tubing and set in a seating ring located on the tubing. The seating ring has a constricted diameter that will not allow for a conventional OD centralizer to pass through. The centralizer of the present invention can be used beneath the seating ring on the tubing string. By using the apparatus and methods of the present invention, the pump can pass through the centralizer of the present invention and be centralized and stabilized by it. The centralizer of the present invention can be used in both horizontal and vertical positions.

As indicated previously, centralizing devices exist and various designs are common, most common being the bow spring OD centralizer. A common problem with the OD centralizers is that they all have a minimum compressed diameter limiting the environments they can be deployed in. Embodiments of the present invention can be used to centralize and inhibit the radial motion of a pump or other equipment when deployed through a constricting ID and set in a larger ID than the constricted ID by putting the centralizer in the tubing and passing the pump or equipment through it. Embodiments of the present invention are intended for specific equipment that must pass through tubing that has a reduced diameter, to be stabilized, when a standard OD centralizer cannot be used as it will not pass through the constriction.

Figure 1:
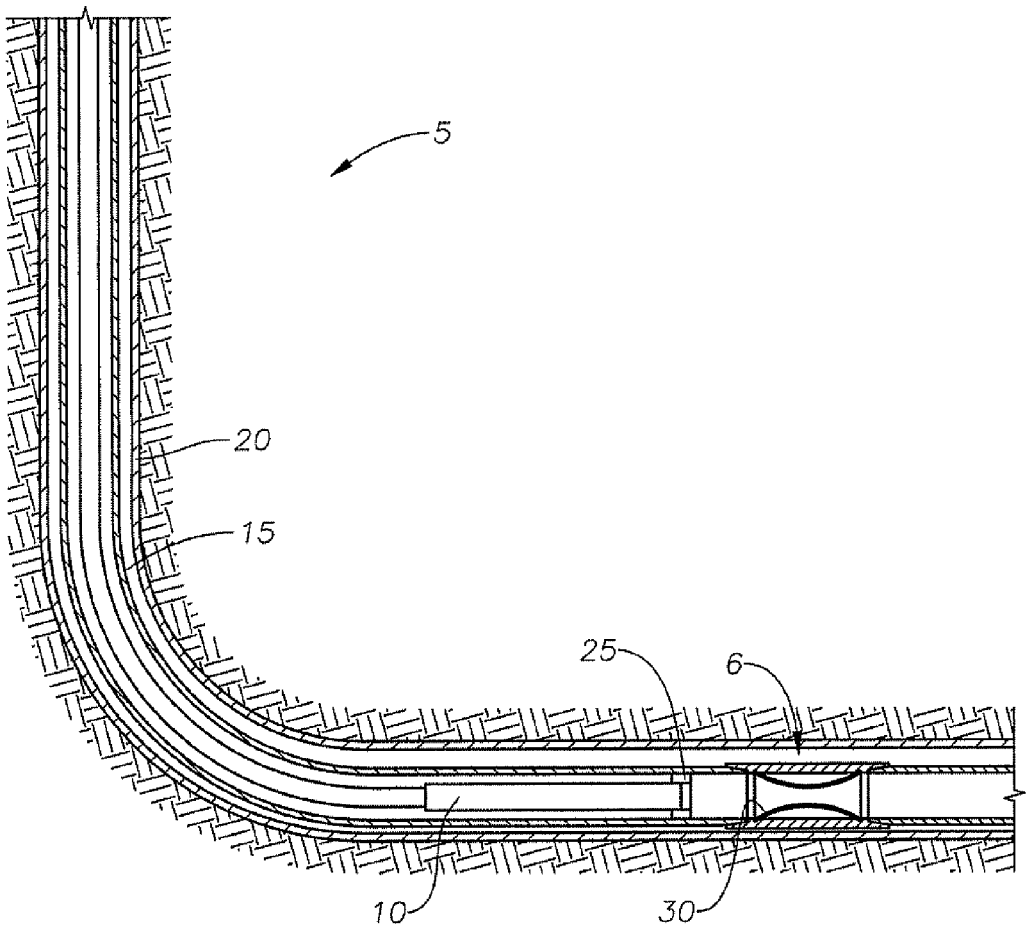
FIG. 1 is a cross-sectional view of a pump contained within tubing having the centralizer installed therein, the pump being upstream of the centralizer prior to the centralizer being engaged, in accordance with embodiments of the present invention.

Turning to the figures, FIG. 1 illustrates a system 5 in which the inner diameter centralizer 6 is installed. The centralizer 6 is retained in the tubing 15. In this system 5, a pump assembly 10 is positioned in tubing 15 that is contained within casing 20. The centralizer 6 has a diameter that is smaller than the inner diameter of the tubing 15. A seating ring 2 is positioned on an inner wall of the tubing 15 to align the pump 10 in the middle of the tubing 15 prior to the pump 10 reaching the inner diameter centralizer 6.

In an aspect, the pump assembly 10 comprises a rotary pump. In a preferred embodiment, the rotary pump is a progressing cavity pump with a helical rotor 44 and a stator 42 contained within a housing 46, as shown in FIG. 4. A string of rods 48 extends downward from a drive motor (not shown) at the surface and connects to rotor 44 for rotating rotor 44. Rods 48 normally comprise individual solid steel members that have threaded ends for coupling to each other. The combination of rotor 44 and rods 48 define a drive string for pump assembly 10. The stator 42 lands in a seat to keep it from rotating.

Figure 2:
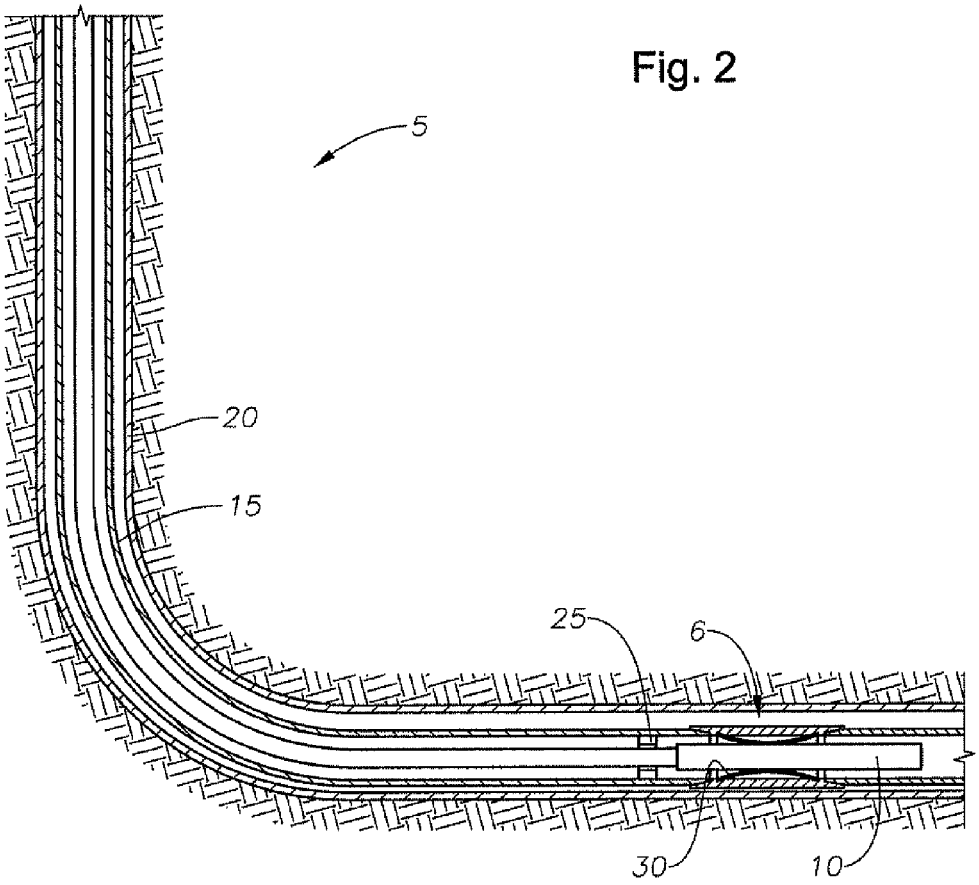
FIG. 2 is a cross-sectional view of a pump contained within tubing having the centralizer installed therein, the pump being upstream of the centralizer prior to the centralizer being engaged, in accordance with embodiments of the present invention.

As shown in FIG. 2, once the pump 10 passes the seating ring 25 and reaches the inner diameter centralizer 6, the inner diameter centralizer 6 compresses to allow the pump 10 to pass through the tubing 15. The centralizer 6 has inwardly arched sides that expand toward an inner wall of the tubing 15 to centralize and inhibit radial movement of the pump 10. The inner diameter centralizer 6 aligns and centers the pump 10 within the tubing 15. The minimum ID of centralizer 6 is smaller than the maximum OD of the pump 10.

Figure 3:
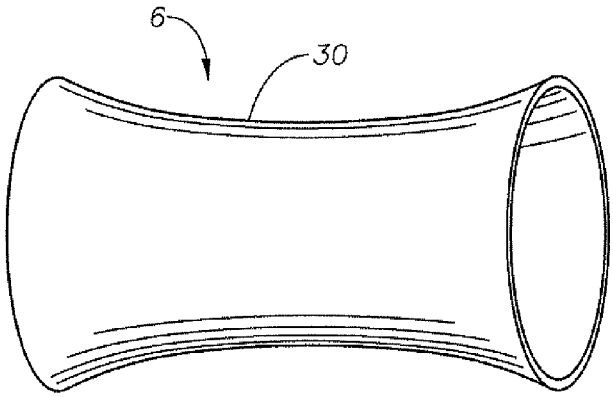
FIG. 3 is a schematic of the inner diameter centralizer having arched sides made in accordance with embodiments of the present invention.

In an embodiment, the inner diameter centralizer 6 includes a formed cylindrical sleeve having a curved hourglass shape in cross-section, as shown in FIG. 3. In an aspect, the centralizer 6 has an inner diameter that increases from a longitudinal midpoint to a longitudinal end point of the centralizer.

In an embodiment, the inner diameter centralizer 6 includes a plurality of inwardly arched bow springs 35, as shown in FIG. 5. The bow springs 35 are connected to a pair of end rings 40. In an aspect, the centralizer 6 has an inner diameter that increases from a longitudinal midpoint to a longitudinal end point of the centralizer 6. In an aspect, the springs 35 or the arched sides of the centralizer 6 define a minimum diameter while in a relaxed condition that is smaller than the portion of the tool passing into the centralizer 6.

The inner diameter centralizer 6 can be constructed from an alloy metal that is flexible enough to yield or give when the pump or equipment is inserted therein. In an aspect, the alloy metal is flexible. Suitable alloy metals that can be used in embodiments of the present invention can include AISI 4340, spring-tempered 301 stainless steel, ASTM 1074/75, or combinations thereof. Other suitable construction materials for the inner diameter centralizer 6 will be apparent to those of skill in the art and are to be considered within the scope of the present invention.

In an aspect, the centralizer 6 can be used with various types of equipment. For example, the centralizer 6 can be used with various types of pumps, such as a rod-driven progressive cavity pump as shown in FIG. 4. Besides pumps, the centralizer 6 can be used with various types of downhole tools. Other types of equipment that can be used with the centralizer 6 will be apparent to those of skill in the art and are to be considered within the scope of the present invention.

As an embodiment of the present invention, a string of well pipe into which a downhole tool is lowered in a well is provided. In this embodiment, an improvement includes a centralizer 6 mounted in the well pipe to centralize the downhole tool. In an aspect, the centralizer 6 has inwardly arched sides defining a minimum inner diameter at a longitudinal midpoint while in an initial position. The inwardly arched sides can be flexed outward at the longitudinal midpoint to centralize the downhole tool as the downhole tool enters the centralizer 6.

In an aspect, the minimum inner diameter of the tubing 15 in the initial position is smaller than a maximum outer diameter of the downhole tool. In another aspect, the centralizer 6 has at least one end that is free to slide axially in the pipe and the tool flexes the arched sides outward.

Another embodiment that includes having a string of well pipe into which a downhole tool is lowered in a well is provided. In this embodiment, an improvement includes a centralizer 6 that is mounted in the well pipe to centralize the downhole tool. The centralizer 6 includes end rings that are connected by inwardly arched bow springs 35 defining an inner diameter at a longitudinal midpoint while in an initial position, as shown in FIG. 5. The inwardly arched springs 35 can be flexed outward at the longitudinal midpoint to centralize the downhole tool as the tool enters the centralizer 6.

In an aspect, the minimum inner diameter of the tubing 15 in the initial position is smaller than a maximum outer diameter of the downhole tool.

In an aspect, the centralizer 6 has at least one end that is free to slide axially in the pipe and the tool flexes the arched sides outward. In an aspect, the centralizer 6 elongates as the tool moves into the centralizer.

As yet another embodiment of the present invention, an apparatus for pumping well fluid up well tubing is provided. In this embodiment, a rotary pump and a centralizer are included. The rotary pump has a maximum outer diameter small enough to lower the pump down the well tubing. The centralizer has inwardly arched bow springs defining a minimum inner diameter at a longitudinal midpoint. The centralizer has a maximum diameter that is small enough to mount the centralizer within the tubing so that when the pump passes into the centralizer, the inwardly arched bow springs flex outward to centralize the pump.

A method of centralizing a downhole tool within a string of well pipe is provided as an embodiment of the present invention. In this embodiment, a centralizer 6 is mounted within the well pipe. As with other embodiments, the centralizer 6 has inwardly arched sides. The tool is then lowered in the pipe and into the centralizer 6. The tool causes the inwardly arched sides to flex outward to centralize the tool.

Embodiments of the present invention can also include the step of landing the pump 10 within a seat while the pump 10 is at least partially within the centralizer 6. In an aspect, the tool or pump 10 is passed completely through the centralizer 6.

As yet another embodiment of the present invention, a method of centralizing a downhole tool within a string of well pipe is provided. In this embodiment, a centralizer 6 is mounted within the well pipe. The centralizer 6 has inwardly arched bow springs. The tool is then lowered in the pipe and into the centralizer 6. The pump causes the inwardly arched bow springs 35 to flex outward to centralize the tool.

Besides being contained within an inner diameter of the tubing 15, the inner diameter centralizer 6 can be part of a packer or other type of device, as will be understood by those of skill in the art. Other types of devices in which the inner diameter centralizer 6 can be used will be apparent to those of skill in the art and are to be considered within the scope of the present invention.

As an embodiment of the present invention, a centralizing apparatus for spacing a pump from walls of tubing 15 is provided. In this embodiment, the apparatus includes a plurality of casing pipe sections making up a casing pipe string; a tubing 15 contained with the casing pipe string; a seating ring positioned on an inner wall of the tubing 15; a pump positioned within the tubing 15; and a centralizer 6 having inwardly arched sides so that an inner diameter of the centralizer 6 increases from a longitudinal midpoint to a longitudinal end point of the centralizer 6. The centralizer 6 is an inner diameter centralizer. The centralizer 6 has a smaller diameter than the tubing 15 so that it can be positioned inside of the tubing 15 downstream of the seating ring in a relaxed position so that when the seating ring and the pump 10 pass through the centralizer 6, the inwardly arched sides expand towards an inner wall of the tubing 15 to centralize and inhibit radial movement of the pump 10 when deployed through the inwardly arched sides of the centralizer 6.

As another embodiment of the present invention, a method of centralizing a pump 10 from walls of tubing 15 contained within casing pipe string is provided. In this embodiment, the casing pipe string includes tubing 15 that has a centralizer positioned therein. The centralizer 6 has inwardly arched sides. The method embodiment includes the steps of moving the pump 10 through the tubing 15 from a relaxed position to a constricted position so that when the pump 10 passes through the centralizer 6, the inwardly arched sides of the centralizer 6 expand towards an inner wall of the tubing 15 to centralize and inhibit radial movement of the pump 10.

In an aspect, the centralizer 6 can be inserted within tubing 15. In another aspect, the centralizer 6 is not attached to the tubing 15.

Figure 6:
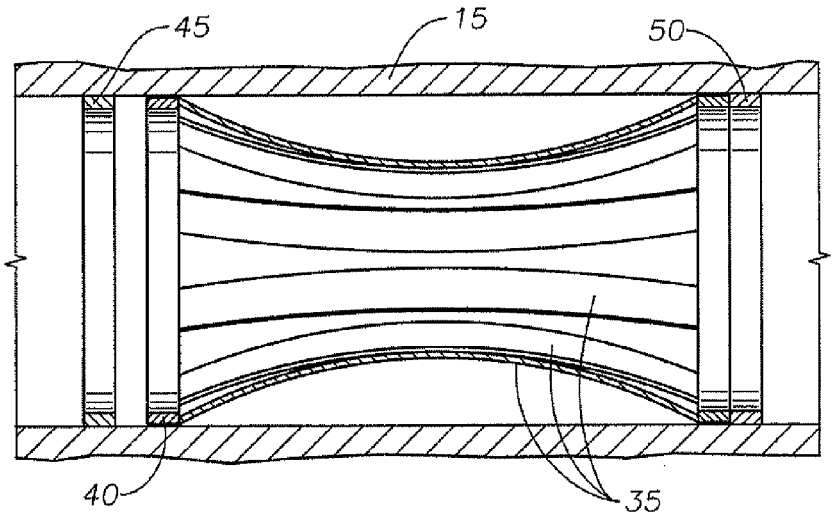
FIG. 6 is a schematic of the inner diameter centralizer in an initial position prior to a tool entering into the inner diameter centralizer in accordance with embodiments of the present invention.
Figure 7:
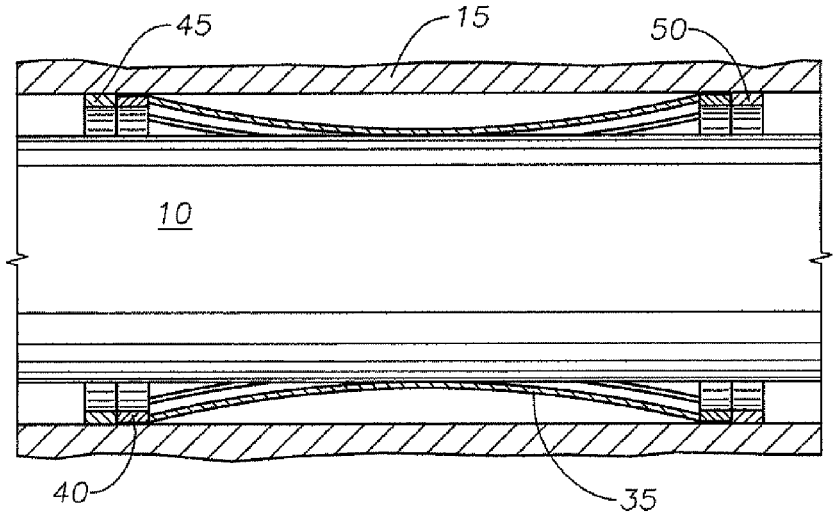
FIG. 7 is a schematic of the inner diameter centralizer in an elongated position while a tool is located in the inner diameter centralizer in accordance with embodiments of the present invention.

To limit the movement of the centralizer in the tubing 15 a first upper stop collar 45 configured to be affixed to an inner surface of the tubing 15 and a second lower stop collar 50 spaced apart from the first stop collar 45 and configured to be affixed to an inner surface of the tubing 15 can also be included in embodiments of the present invention, as shown in FIGS. 6 and 7. The first stop collar 45 can be configured to be affixed to an inner surface of the pipe and the second stop collar 50 can be spaced apart from the first stop collar 45 and configured to be affixed to an inner surface of the pipe. The distance between the collars being greater than a length of the centralizer 6 while the centralizer 6 is in the initial position prior to receiving the tool. The centralizer 6 can be movable between an unexpanded configuration (i.e., prior to the pump 10 or tool being moved through the centralizer 6), as shown in FIG. 6, and an expanded configuration (i.e., while the pump 10 or tool is being moved through the centralizer 6), as shown in FIG. 7. When the pump 10 or tool is located within the centralizer 6, the centralizer 6 becomes longer than in the unexpanded configuration. Embodiments of the present invention can also include the step of stopping movement of the tool down the pipe while the tool is still located within the centralizer 6.

The centralizer 6 or cylindrical sleeve can be constructed of various types of materials. In an aspect, the centralizer comprises an alloy that is AISI 4340, spring-tempered 301 stainless steel, ASTM 1074/75, or combinations thereof. Other suitable materials of construction for the centralizer will be apparent to those of skill in the art and are to be considered within the scope of the present invention.

The shape of the centralizer 6 can be any shape that allows the centralizer to function as intended. For example, the centralizer 6 can be hour-glass shaped in cross-section, as shown in FIGS. 3 and 5. Furthermore, the centralizer 6 can be pierced, such as with slits. By adding slits to the centralizer 6, this allows for the spring action of the centralizer 6. A typical solid object would not allow for spring action, because there would be no void for the displaced material to fill. By putting slits in the centralizer 6, a location is provided for the displaced material. As the pump is inserted into the centralizer 6, the spring material moves away from the pump and occupies the slits. When there are not slits in the cylindrical sleeve embodiment of the centralizer 6, the materials of construction would have to be compressible, or the ID would have to be slightly larger than the stator OD, allowing for a slip fit. Other suitable shapes and features for the centralizer 6 will be apparent to those of skill in the art and are to be considered within the scope of the present invention.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

Throughout this application, where patents or publications are referenced, the disclosures of these references in their entireties are intended to be incorporated by reference into this application, in order to more fully describe the state of the art to which the invention pertains, except when these reference contradict the statements made herein.

The invention claimed is:

1. In a well, having a string of well pipe into which a downhole tool is lowered, the improvement comprising:

a. a centralizer mounted in the well pipe to centralize the downhole tool, the centralizer having inwardly arched sides defining a minimum inner diameter at as longitudinal midpoint while in an initial position, the inwardly arched sides being flexing ourward at the longitudinal midpoint to centralize the downhole tool as the downhole tool enters the centralizer; and b. a seat mounted in the well pipe, the seat operable to inhibit rotation of the downhole tool in response to landing the downhole tool within the seat while the downhole tool is at least partially within the centralizer.

2. The apparatus of claim 1, wherein the minimum inner diameter in the initial position is smaller than a maximum outer diameter of the downhole tool.

3. The apparatus of claim 1, wherein the centralizer has at least one end that is free to slide axially in the pipe and the tool flexes the arched sides outward.

4. The apparatus of claim 1, further comprising a first stop collar configured to be affixed to an inner surface of the pipe and a second stop collar spaced apart from the first stop collar and configured to be affixed to an inner surface of the pipe, the distance between the collars being greater than a length of the centralizer while the centralizer is in the initial position prior to receiving the tool.

5. The apparatus of claim 1, wherein the centralizer is hour-glass shaped in cross-section.

6. In a well, having a string of well pipe into which a downhole tool is lowered, the improvement comprising:

a. a centralizer mounted in the well pipe to centralize the downhole tool, the centralizer having end rings connected by inwardly arched bow springs defining an inner diameter at a longitudinal midpoint while in an initial position, the inwardly arched springs being flexible outward at the longitudinal midpoint to centralize the downhole tool as the tool enters the centralizer; and b. a seat mounted in the well pipe, the seat operable to inhibit rotation of the downhole tool an response to landing the downhole tool within the seat while the downhole tool is at least partially within the centralizer.

7. The apparatus of claim 6, wherein minimum inner diameter in the initial position is smaller than a maximum outer diameter of the downhole tool.

8. The apparatus of claim 6, wherein the centralizer has at least one end that is free to slide axially in the pipe and the tool flexes the arched sides outward.

9. The apparatus of claim 6, further comprising a first stop collar configured to be affixed to an inner surface of the pipe; and a second stop collar spaced apart from the first stop collar and configured to be affixed to an inner surface of the pipe; the distance between the collars being greater than a length of the centralizer while the centralizer is in the initial position prior to receiving the tool.

10. The apparatus of claim 6, wherein the centralizer is hour-glass shaped in cross-section.

11. An apparatus for pumping well fluid up well tubing comprising:

a. a rotary pump having a maximum outer diameter small enough to lower the pump down the well tubing;

b. a centralizer having inwardly arched bow springs defining a minimum inner diameter at a longitudinal midpoint, the centralizer having a maximum diameter small enough to mount the centralizer within the tubing so that when the pump passes into the centralizer, the inwardly arched bow springs flex outward to centralize the pump; and c. a seat mounted in the well tubing, the seat operable to inhibit rotation of the rotary pump in response to landing the rotary pump within the seat while the rotary pump is at least partially within the centralizer.

12. The apparatus of claim 11, wherein the minimum inner diameter of the centralizer is smaller than the maximum outer diameter of the pump.

13. A method of centralizing a downhole tool within a string of well pipe comprising:

a. mounting a centralizer within the well pipe, the centralizer having inwardly arched sides;

b. lowering the tool in the pipe and into the centralizer, the tool causing the inwardly arched sides to flex outward to centralize the tool; and c. landing the tool within a seat while the tool is at least partially within the centralizer.

14. The method of claim 13, wherein the inwardly arched sides define a minimum diameter while in a relaxed condition that is smaller than the portion of the tool passing into the centralizer.

15. The method of claim 13, wherein at least one end of the centralizer is free to slide axially within the pipe.

16. The method of claim 13, wherein the centralizer elongates as the tool moves into the centralizer.

17. The method of claim 13, wherein the centralizer is hourglass shaped in cross-section.

18. The method of claim 13, wherein the tool comprises a pump.

19. The method of claim 13, further comprising passing the tool completely through the centralizer.

20. The method of claim 13, further comprising stopping movement of the tool down the pipe while the tool is still located within the centralizer.

21. A method of centralizing a downhole tool within a string of well pipe comprising:

a. mounting a centralizer within the well pipe, the centralizer having inwardly arched bow springs;

b. lowering the tool in the pipe and into the centralizer, the tool causing the inwardly arched bow springs to flex outward to centralize the tool; and c. landing the tool within a seat while the tool is at least partially within the centralizer.

22. The method of claim 21, wherein the springs define a minimum diameter while in a relaxed condition that is smaller than the portion of the tool passing into the centralizer.

23. The method of claim 21, wherein at least one end of the centralizer is free to slide axially within the pipe.

24. The method of claim 21, wherein the centralizer elongates as the tool moves into the centralizer.

25. The method of claim 21, wherein the centralizer is hour-glass shaped in cross-section.

26. The method of claim 21, wherein the tool comprises a pump.

27. The method of claim 21, further comprising passing the tool completely through the centralizer.

28. The method of claim 21, further comprising stopping movement of the tool down the pipe while the tool is still located within the centralizer.

* * * * *

UNITED STATES PATENT AND TRADEMARK OFFICE

CERTIFICATE OF CORRECTION

PATENT NO. : 8,561,708 B2
APPLICATION NO. : 12/986480
DATED : October 22, 2013
INVENTOR(S) : Nicholas D. Johnson et al.

It is certified that error appears in the above-identified patent and that said Letters Patent is hereby corrected as shown below:

IN THE CLAIMS:

Column 6, line 53, after "being" delete "flexing ourward" and insert --flexible outward--

Signed and Sealed this
Third Day of June, 2014

Michelle K. Lee

Michelle K. Lee
*Deputy Director of the United States Patent and Trademark Office*